US005704063A

United States Patent [19]

Tilden

[11] Patent Number: 5,704,063

[45] Date of Patent: Jan. 6, 1998

[54] FACE COVERING

[76] Inventor: Mark Tilden, 1305 Labelle Street, St-Jovite, Quebec, Canada, J0T 2H0

[21] Appl. No.: 664,208

[22] Filed: Jun. 11, 1996

[30] Foreign Application Priority Data

Nov. 16, 1995 [CA] Canada ..... 2184638

[51] Int. Cl.[6] ..... A61F 9/00

[52] U.S. Cl. ..... 2/9; 2/427; 2/13; 2/12; 128/857; 128/863

[58] Field of Search ..... 2/13, 9, 12, 10, 2/427, 428, 429, 430, 435, 436, 437; 128/857, 858, 863; 351/47, 158, 155

[56] References Cited

U.S. PATENT DOCUMENTS

| | | | |
|---|---|---|---|
| 960,520 | 6/1910 | Dysthe | 2/206 |
| 1,279,884 | 9/1918 | La Roche | 128/863 X |
| 3,823,418 | 7/1974 | Piper | 2/206 |
| 3,838,466 | 10/1974 | Poirier | 2/436 |
| 3,991,753 | 11/1976 | Viesca Y Viesca | 2/9 |
| 4,126,131 | 11/1978 | Davis et al. | 2/436 |
| 4,250,577 | 2/1981 | Smith | 2/427 |
| 4,464,797 | 8/1984 | Glassman | 351/155 |
| 4,520,509 | 6/1985 | Ward | 2/206 |
| 4,641,379 | 2/1987 | Martin | 2/9 |
| 4,653,124 | 3/1987 | McNeal et al. | 2/427 |
| 4,821,340 | 4/1989 | Johnson | 2/9 |
| 4,825,474 | 5/1989 | Edwards | 2/206 |
| 4,944,039 | 7/1990 | Dietrich | 2/13 |
| 5,035,006 | 7/1991 | Hetz et al. | 2/209.1 |
| 5,123,116 | 6/1992 | Roth | 2/171 |
| 5,206,956 | 5/1993 | Olson | 2/13 |
| 5,214,804 | 6/1993 | Carey et al. | 2/206 |
| 5,424,787 | 6/1995 | Zegarelli | 351/158 |
| 5,493,734 | 2/1996 | Nieves-Rivera | 2/207 |

FOREIGN PATENT DOCUMENTS

| | | | |
|---|---|---|---|
| 513750 | 10/1939 | United Kingdom | 2/9 |

OTHER PUBLICATIONS

Grand Manitou (Brochure) Apr. 3, 1995/Jun. 2, 1995.

*Primary Examiner*—Jeanette E. Chapman

*Attorney, Agent, or Firm*—Ronald S. Kosie; Robert Brouillette

[57] ABSTRACT

An altenative face protector made of a covering body for covering at least a portion of a user's face below the eye area thereof, and attachments for attaching the covering body to a user. The face protector covers at least a portion of a user's face and it comprises a breathing vent skirt element. The breathing vent skirt element has a skirt edge, and is configured such that when the face protector is worn by the user, the breathing vent skirt element, from the tip of the nose of the user, projects outwardly and extends downwardly in such a manner that the breathing vent skirt element defines an outer wall of a nostril air pocket extending below the nostril area of the user's nose. The nostril air pocket has a lower nostril opening which is in air communication, at an upper end thereof, with the nostril area of the user's nose and, at the lower nostril opening, with the atmosphere. The skirt edge defines a portion of the lower nostril opening and is disposed so as to be at a level at least as low as the upper edge of the upper lip of the user. The nostril air pocket is configured and disposed such that when air is exhaled by the user, the exhaled air is directed downwardly from the user's nostril area into the atmosphere, through the lower nostril opening.

8 Claims, 8 Drawing Sheets

FACE COVERING

BACKGROUND OF THE INVENTION

The present invention relates to a body covering and in particular to an article of clothing or a garment, which may for example be used to protect the face and/or neck of a user who is to be exposed to harsh environments or conditions such as cold air. The garment may for example be used by downhill skiers to protect the user against cold air.

Masks are known which may, for example, be used outdoors in cold weather by, among others, skiers, snowmobilers, campers, outdoor enthusiasts, utility workers, constructions workers and others who may be exposed to cold weather. Masks are also known for use in certain types of warm weather, whether to protect against the sun, hot air or winds.

A number of face masks and face protectors are, for example, described in U.S. Pat. No. 4,641,379 (Martin), U.S. Pat. No. 5,035,006 (Hetz et al.) U.S. Pat. No. 4,653,124 (McNeal et al.) U.S. Pat. No. 4,825,474 (Edwards) and U.S. Pat. No. 5,214,804 (Carey et al.).

Present mask designs have a number of drawbacks. For example, exhaled air has a high moisture content. Accordingly, when a face mask is worn in a cold weather environment, water in the exhaled air can, upon contact with the cold air, condense out of the exhaled air; such condensed water may then collect on the various surfaces of the mask and freeze thereon. An accumulation of such ice may have the effect that the wearer's skirt may eventually come into contact with a cold and icy mask thus creating discomfort to the user which will increase as long as the mask is in use. The condensed water may also fog a goggle means such as for example shield visor, goggles, glasses or any protective eyewear which may be worn by the user and may thus temporally at least blind the user to any dangers in his or her immediate surroundings.

For example, known masks are often designed in a manner such that the user must breathe directly through the material of the mask, or through small openings cut therethrough. Such masks may thus act as traps for humidity from the exhaled air of the user. This humidity as mentioned may condense on contact with cold air, and freeze on the mask. The frozen water may eventually accumulate to the point of acting as a physical barrier which may prevent or inhibit the passage of air when the user inhales or exhales. In this condition not only may it be difficult for the user to breathe, but humid air may tend to be trapped inside the mask such that the humid air may find its way into the protective eyewear or goggles thus causing fogging thereof.

Accordingly it would be advantageous to have a face covering having a breathing structure which facilitates the venting of exhaled air into the atmosphere so as to reduce or minimize the condensation of moisture out of the exhaled air in or on the mask.

It would also be advantageous to have a face covering having a breathing structure which facilitates the venting of exhaled air to the atmosphere so as to reduce or minimize the fogging of protective eyewear worn by the user with the face mask.

It would also be advantageous to have a face coveting which, as designed, would protect only the cheek areas of the face as well as the nose and mouth area or as desired also the chin and/or neck of a user.

SUMMARY OF INVENTION

Thus, the present invention in accordance with a general aspect provides a face protector comprising a covering body for covering at least a portion of a user's face below the eye area thereof, and attachment means for attaching the covering body to a user, such that said covering body covers at least a portion of a user's face said covering body comprising a breathing vent skirt element, said breathing vent skirt element having a skirt edge, said breathing vent skirt element being configured such that when the said face protector is worn by the user, said breathing vent skirt element, from the tip of the nose of the user, projects outwardly and extends downwardly such that said breathing vent skirt element defines an outer wall of a nostril air pocket extending below the nostril area of the user's nose, said nostril air pocket having a lower nostril opening, said nostril air pocket being in air communication, at an upper end thereof, with the nostril area of the user's nose and, at the lower nostril opening, with the atmosphere, and the skirt edge defines a portion of said lower nostril opening and is disposed so as to be at a level at least as low as the upper edge of the upper lip of the user said nostril air pocket being configured and disposed such that when air is exhaled by the user, the exhaled air is directed downwardly from the user's nostril area into the atmosphere, through the lower nostril opening.

In accordance with the present invention, for example, the face protector may have the skirt edge defining a portion of said lower nostril opening and disposed so as to be at a level at least as low as the lower edge of the lower lip of the user.

In accordance with the present invention a face protector member may cover and protect the face of the user only until the level of the mouth. In this case however, the face protector or covering member leaves a space in front of the mouth which enables the exhaled air to be vented and thus inhibit the accumulation of condensation. If desired the face protector may cover at least a major part the face and neck of a user; for this purpose it may thus be a single piece or a plurality of pieces or members (e.g. releasable attached together by a suitable attachment system such as for example a loop and pile system).

Accordingly, a face covering in accordance with the present invention may comprise in addition to an upper flexible member, a second piece or second flexible lower member can be added to the first flexible upper piece in order to cover the lower face, the chin and the neck level to immediately below the lower lip. The combination of this first flexible upper piece and the second flexible lower piece creates a free space before the mouth of the user which enables the exhaled air to be vented directly to the exterior air.

In accordance with the present invention a first flexible upper piece may include secondary attachment means whereby the first flexible upper piece may also be attached to the elastic band (or the like) of goggles. In addition, the goggles may have a pinching effect on the top of the first flexible upper piece so as to render an airtight connection between the two.

The present invention in particular provides a face protector or covering comprising a covering body for covering at least a portion of a user's face below the eye area thereof, and attachment means for attaching the covering body to a user, such that said covering body covers said portion of a user's face, said covering body comprising a lower edge and a breathing vent skirt element, said breathing vent skirt element having a skirt edge defined by a portion of said lower edge, said breathing vent skirt element being configured such that when said face protector is worn by the user, said breathing vent skirt element, from the tip of the nose of the user, projects outwardly and extends downwardly such that said breathing vent skirt element defines an outer wall of a nostril air pocket extending below the nostril area of the user's nose, said nostril air pocket having a lower nostril opening, said nostril air pocket being in air communication, at an upper end thereof, with the nostril area of the user's nose and, at the lower nostril opening, with the atmosphere, and the skirt edge defines a portion of said lower nostril opening and is disposed so as to be at a level at least as low as the upper edge of the upper lip of the user (e.g. the skirt edge may be disposed so as to be at a level at least as low as the lower edge of the lower lip of the user)

said nostril air pocket being configured and disposed such that when air is exhaled by the user, the exhaled air is directed downwardly from the user's nostril area into the atmosphere, through the lower nostril opening.

As may be understood, the covering body may be configured so as to be able to cover only a tip end portion of the nose of a user or if desired or as necessary the covering body may be configured to cover up to a substantial part or even essentially all of the nose of a user. The covering body may indeed only cover the area in front of the mouth and below the nose of a user.

As may also be understood, the covering body may be configured so as to be able to cover only part of the face of a user or if desired or as necessary the covering body may be configured to cover up to a substantial part or even essentially all of the face of a user.

The nostril air pocket in effect acts as an extension to the nostril area so as to effectively extend the nostril openings of a user to a level which may be the same as the mouth of the user or to a level below the lower lip of the user. The portion of the user's face in the area opposite the vent skirt defines the inner wall of the nostril opening.

In accordance with the present invention, the breathing vent skirt element may be configured such that when the face coveting is worn by a user, the portion of the lower edge defining the skirt edge may be disposed so as to be at a level which is below the lower edge of the lower lip of the user.

As mentioned above the breathing vent skirt extends downwardly from the tip of the user's nose. The angle of inclination of the breathing vent skirt element with respect to the plane of the face of a user may take on any desired value. If desired or necessary the skirt element when the face covering is worn by a user may have a component which may be parallel to the plane of the face of a user. In any case the inclination of the skirt element must be chosen keeping in mind that the exhaled air must be directed downwardly from the nostril area of a user. Thus for example, in accordance with the present invention, the breathing vent skirt element may be configured such that when the face covering is worn by a user, the portion of the lower edge defining said skirt edge may project outwardly from the face of the user and follow the slope of the user's nose.

In accordance with the present invention a covering body may also comprise an upper edge having a goggle gasket edge portion configured such that when a user wears the face covering and goggle means comprising a goggle rim member contoured to fit over the nose and under the eye socket area of the user, the goggle gasket edge portion is able to fit contourly over the bridge of the nose and under the eye socket area of the user such that said goggle rim member is able to engage said gasket edge portion so as to sandwich the said gasket edge portion between the face of the user and the said goggles means.

In accordance with the present invention, a face protection or covering may, for example, comprise two parts, namely a first upper flexible member and second lower flexible member.

In accordance with a particular aspect of the present invention there is thus provided a face mask comprising a first flexible upper member comprising a first upper edge, a first lower edge, and a breathing vent skirt element, said breathing skirt vent element having a skirt edge defined by portion of said first lower edge, a second flexible lower member comprising a second upper edge, and a second lower edge first attachment means for releasable attaching said first flexible upper member to a user, second attachment means for releasable attaching said second flexible lower member to a user, third attachment means for releasable attaching said first flexible upper member to said second flexible lower member, said first upper member, said second lower member and said third attachment means being configured such that when the first upper member is attached to the second lower member and the said face mask is worn by the user, said breathing vent skirt element, from the tip of the nose of the user, projects outwardly and extends downwardly such that said breathing vent skirt element defines an outer wall of a nostril air pocket extending below the nostril area of the user's nose, said nostril air pocket having a lower nostril opening, said nostril air pocket being in air communication, at an upper end thereof, with the nostril area of the user's nose and, at the lower nostril opening, with the atmosphere, and the skirt edge defines a portion of said lower nostril opening and is disposed so as to be at a level at least as low as the upper edge of the upper lip of the user (e.g. the skirt edge may be disposed so as to be at a level at least as low as the upper edge of the upper lip of the user)

said nostril air pocket being configured and disposed such that when air is exhaled by the user, the exhaled air is directed downwardly from the user's nostril area into the atmosphere, through the lower nostril opening, said first upper member and said second lower member being configured such that when the face mask is worn by the user, a portion of the second upper edge of the second lower member is disposed adjacent the mouth area of the user, is disposed at a level adjacent to or lower than the lower edge of the lower lip of the user's mouth, and defines a portion of the lower nostril opening said first upper edge of said first upper member comprising a goggle gasket edge portion configured such that when a user wears said face mask and goggle means comprising a goggle rim member contoured to fit over the nose and under the eye socket area of the user, the said goggle gasket edge portion is able to fit contourly over the bridge of the nose and under the eye socket area of the user such that said goggle rim member is able to engage said gasket edge portion so as to sandwich the said gasket edge portion between the face of the user and the said goggles.

In accordance with the present invention, a face covering (e.g. a face mask as described herein) may also include a further or fourth attachment means for securing the covering body (e.g. an flexible upper member) to the head attachment means of goggle means when said goggle means and said face covering are worn by the user.

Thus the face protector (e.g. a face mask) of the present invention may be worn by a user in conjunction with known goggles (e.g. ski goggles or any other suitable eyewear) which may, for example, have an elastic band for attaching the goggles to a user's head. However the face protector of the present invention is not limited to being used with goggles having an elastic band; it may be used witside arms able eyewear such as for example eyewear having side arms for nesting between the ears and head of a user.

In accordance with the present invention, one or more of the above mentioned attachment means (e.g. side fastener means) may comprise loop and pile fastener means, such as for example those which are commonly known by their trade-mark VELCRO®. It is of course understood that the fastener means of the present invention are not limited to loop and pile fastener means but can be any other suitable attachment means. These may, for example, include button and slot means, zipper means, pressure snap means and the like.

In accordance with the present invention the coveting body (e.g. the first upper and/or second lower members) may be made of a fabric material. The fabric material may have opposing first and second surfaces. The first surface may, for example, be of a water repellent fabric and the second surface may be of a soft fabric. The soft fabric side area may be the side which is worn against a user's skirt. It is of course understood that any other suitable or desired material or combination of materials may be used for the construction of the covering.

In accordance with the present invention, a face covering (e.g. face mask) may have a further or fourth attachment means which may comprise two loop and pile fastener elements. Each such loop and pile element may be disposed on a first upper member such that when the first upper member is attached to a user's head, each loop and pile element may be disposed on an opposite side of the user's head.

In accordance with the present invention, the face protector may comprise only an upper member which may be configured in the form of a first band having opposite ends. Alternatively, as described herein a face mask may also comprise second lower member. The second lower member may be configured in the form of a second scarf band having opposite ends. The opposite ends of the first band member may be releasable attachable together by the first attachment means for attaching the first band to a user. Similarly, the opposite ends of said scarf band may be releasable attachable together by the second attachment means for attaching said second scarf band to a user.

A face coveting in accordance with the present invention may be so disposed as to facilitate breathing while at the same time limiting or avoiding water condensation and freezing on the mask; it may also keep the face of the user protected without leading to fog in the goggles of the user, and this without unduly restricting the range of movements or motion of the user. A flexible face covering in accordance with the present invention may in particular provide a relatively high level of comfort to the user. Thus in accordance with the present invention a face covering may for example as described herein be constructed of two flexible pieces or bands which may be removably attachable to each other and to the user. Such a face covering may for example be adapted by a user to accommodate various climatic conditions since a user may choose the level or degree of protection that is required or desired.

In the drawings which illustrate example embodiments of the present invention:

Figure 1:
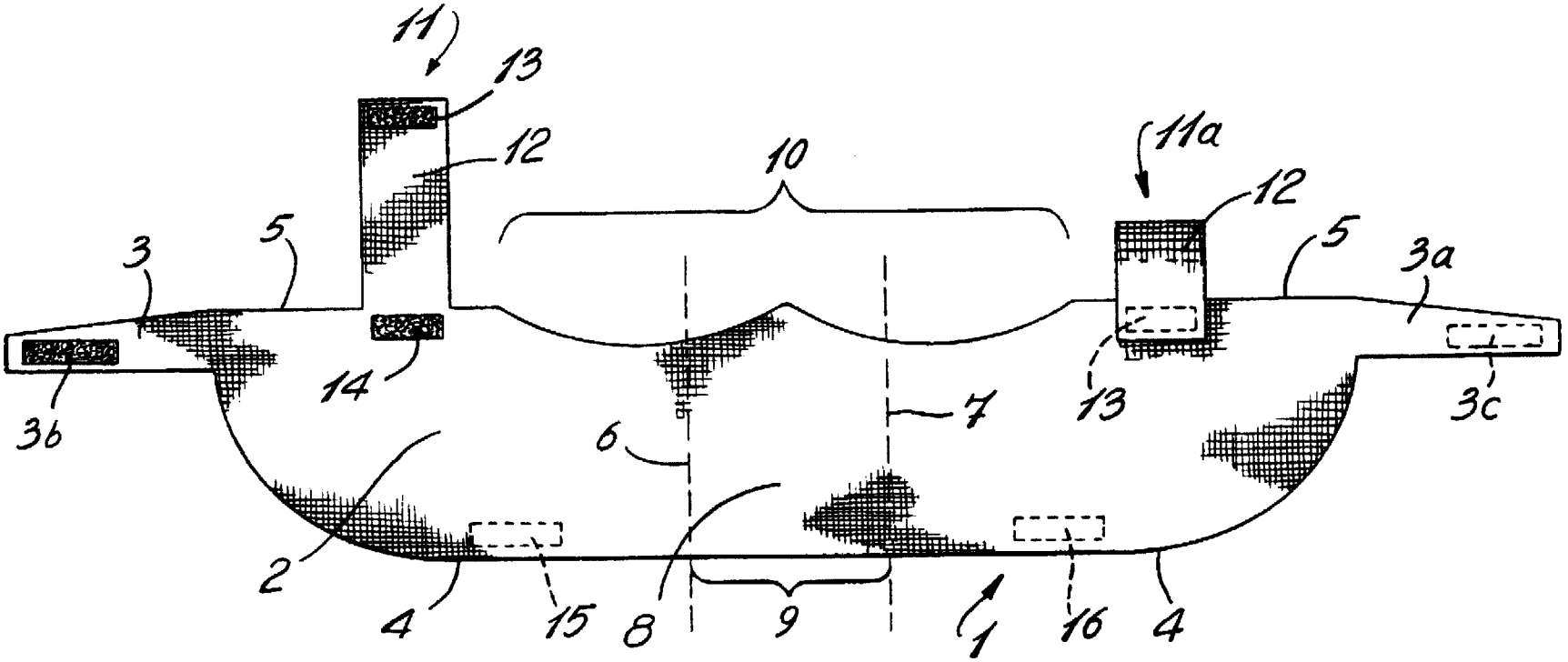
FIG. 1 is a from view of an example embodiment of a face protector in accordance with the present invention.

Turning to FIG. 1, this figure schematically shows a face protector 1 in accordance with the present invention and is shown unmounted to the face and head of a user. As shall be discussed below, the face protector 1 is configured to protect the nose, mouth and cheek areas of a user's face.

The face protector 1 is in the form of a flexible band and is shown with the from face or surface thereof exposed; the rear or skirt side surface of the protector is hidden from view on the other opposite side of the protector. The face protector 1 has a covering body 2 for covering the portion a user's face below the eye area thereof, i.e. for covering the nose, mouth and cheek areas of the face. The covering body 2 has attachment strip members 3 and 3*a* which are respectively connected to opposite ends of the covering body 2. The attachment members 3 and 3*a* respectively include a loop element 3*b* and a pile element 3*e* which are disposed on opposite sides of the face protector, i.e. the loop and pile elements 3*b* and 3*c* make up a Velcro® style releasable fastener or attachment means.

The covering body has a lower edge designated generally by the reference numeral 4 and an upper edge generally designated by the reference numeral 5.

A central part of the covering body 2 is destined to cover the nose area of the user. This central part is shown as being delineated in general fashion by the dotted lines 6 and 7. It is to be understood of course that the particular disposition of these dotted lines is for illustration purposes only; the actual disposition of this central nose area may be larger or smaller as desired or necessary. The lower portion of this central nose area defines a breathing vent skirt element and is generally designated by the reference numeral 8. The breathing vent skirt element 8 has a skirt edge 9 which is defined by a respective portion of the lower edge 4; again the skirt edge as shown is given by way of illustration only.

The covering body 2 as mentioned above has an upper edge 5. The upper edge 5 has a central edge portion designated generally by the reference numeral 10. The central edge portion 10 of the upper edge 5 is configured such that it will be able to fit contourly over the bridge of the nose and under the eye socket area of the user. In the illustrated embodiment the covering body 2 is also sized such that the central edge portion 10 is able to define a goggle gasket edge portion for disposition between a user's face and elements of a goggle means so as to act as an air seal therebetween; this shall be discussed further below.

The gasket edge portion as defined by the central edge portion 10 may if desired be made of a different material, of a thicker material or of a different construction than the rest of the face protector 1 to better suit the intended purpose thereof, i.e. a sealant function.

The face protector 1 also has a pair of secondary attachment means each of which are generally designated by the reference numerals 11 and 11*a*. These secondary attachment means 11 and 11*a* may advantageously be used to attach the face protector, for example, to the elastic band of goggle or to the side arms of other types of eyewear. Each attachment means 11 and 11*a* comprises a strap or flap 12, a loop element 13 and a pile element, i.e. the loop and pile elements 13 and 14 make up a Velcro® style releasable fastener or attachment means. The attachment means 11 is shown in an open configuration while the attachment means 11*a* is shown in a closed configuration. In the closed configuration the attachment means define a channel or pocket in which for example the elastic band of goggles may be engaged so as to attach the face protector to the goggles at opposite sides of the head of the user.

The face protector 1 may as desired be used alone. However, advantageously it may be used with a second covering member for the neck, as shall be described below. If the face protector 1 is intended to be used with a second covering member, such as described below, the face protector 1 may be provided with loop elements 15 and 16 which are intended to cooperate with corresponding pile elements of the second covering member so as to provide a releasable connection therebetween, i.e. in the style of a Velcro® type connection. If desired of course one or both of the loop elements 15 and 16 may be replaced by a pile element; in this case it is of course necessary that the correspond attachment element of the second member be changed to a corresponding loop element.

Figure 2:
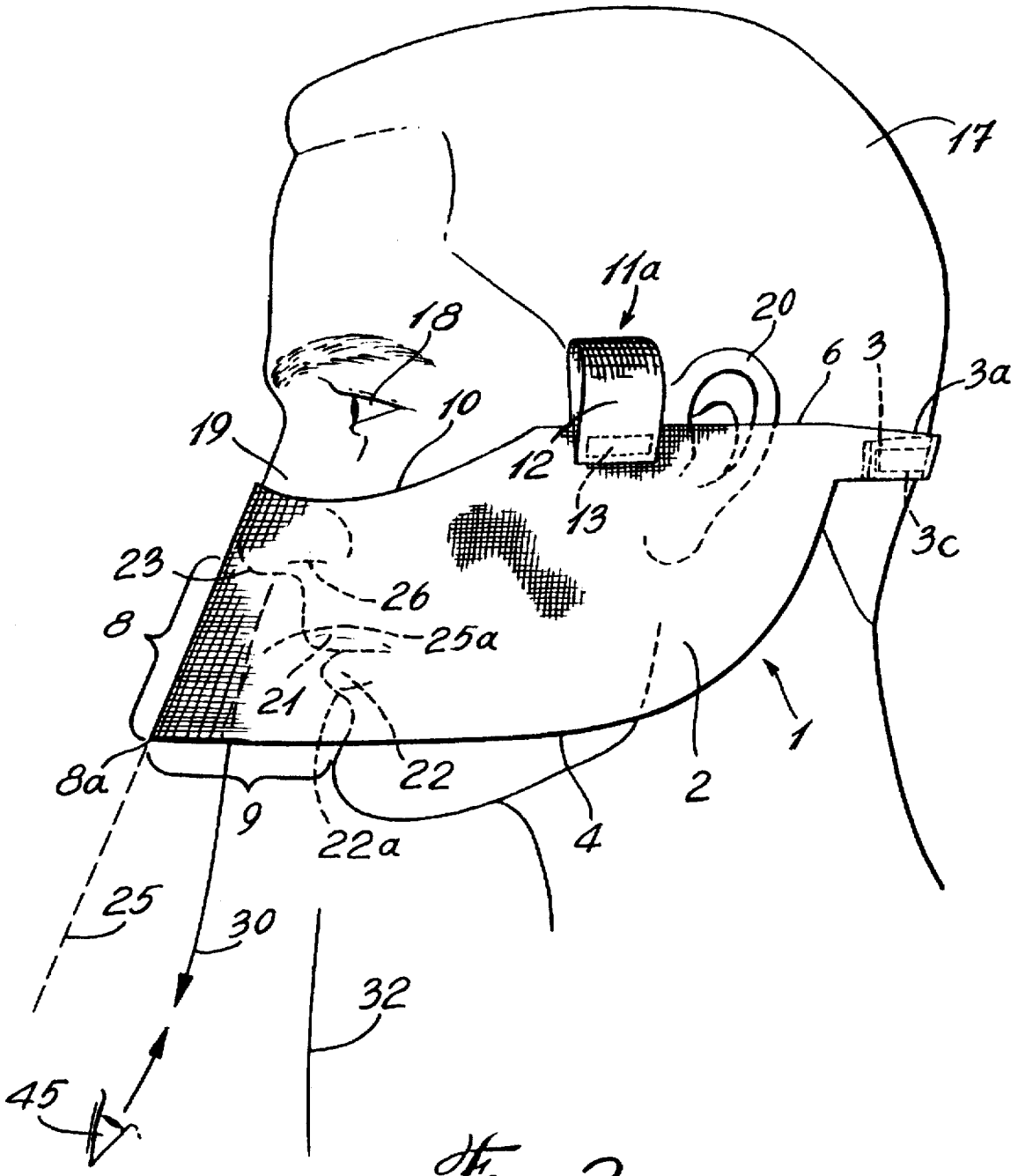
FIG. 2 is a schematic side view of a user's head showing the face protector of FIG. 1 attached thereto.

FIG. 2 shows a face protector 1 of FIG. 1 attached to the head of a user such that it covers the nose, mouth and cheek areas of the face of the user; the nose and mouth are seen in dotted outline. As may be seen the eyes (one of which is designated by the reference numeral 18) of the user are not covered by the face protector 1. As may be appreciated the face protector is attached to the head 17 of the user by the attachment members 3 and 3*a* at the back of the head.

As shown in FIG. 2, the upper central edge 10 is disposed so as to extend below the eyes of the user, i.e. along the lower portion of the eye socket area and over the bridge of the nose of the user (the nose is designated by the reference numeral 19). As well, the covering body 2 is shaped to extend contourly along the upper portion of the cheek bone area on each side of the face of the user, back toward and over a portion of the ears (one of which is shown as being designated by the numeral 20. When the covered face is viewed straight on the covering body 2 covers the upper and lower lips 21 and 22 (see FIG. 9). It is understood, however, that covering body 2 may as described above be at a higher level and thus only cover the upper edge of the upper lip 21.

The breathing vent skirt element 8 extends outwardly and downwardly from the tip 23 of the nose 19 such that the breathing vent skirt element 8 projects outwardly from the face of the user and the skirt edge 9 is at a level equal to the level of the lower edge 22*a* of the lower lip 22. Although shown in FIG. 2 (as well as FIGS. 7 and 9) as reaching to the level of the lower edge of the lower lip 22*a*, skirt edge 9 may if desired or necessary, extend only to the level of the upper edge of the upper lip 21. As can be seen the breathing vent skirt element 8 drapes over the nose 19. If desired or necessary, the covering body 2 could of course be configured and disposed such that the skirt edge 9 is at some desired level below the lower edge 22*a* of the lower lip (e.g. to some level more or less opposite the bottom of the chin of a user). In any event the level of the skirt edge 9 should not be such as to interfere with the exhalation of air to the atmosphere nor the inhalation of fresh air from the atmosphere.

As may be seen from the FIG. 2 the breathing vent skirt element follows the slope of the nose of the user, i.e. it extends in the direction of the arrow 25 which is in the plane defined by the slope of the nose 19.

The breathing vent skirt element 8 defines an outer wall of a nostril air pocket 25*a*; the nose 19 lips 21 and 22, etc, of the user define the inner wall of this air pocket. As may be seen the upper end of the air pocket is in air communication with the nostril area of the user (one nostril is shown with the reference number 26). The nostril air pocket has a lower nostril opening; the skirt edge 9 defines a portion of the periphery of the lower nostril opening. As may be appreciated as the user exhales air, the air is directed downwardly towards the lower nostril opening from which the air is expulsed to the atmosphere (see arrow 30); the reverse path is followed by fresh inhaled air. If desired of course the breathing vent skirt element may extend downwardly from the tip 23 of the nose more or less parallel to the plane 32 of the face of the user or may at some distance from the tip 23 of the nose include such a parallel component. Additionally the slope of the breathing vent skirt element 8 may be different from that of the nose (e.g. it may be at a smaller or larger angle with respect to the plane 32 of the face). In any event the skirt edge must nevertheless be disposed as described herein.

Figure 3:
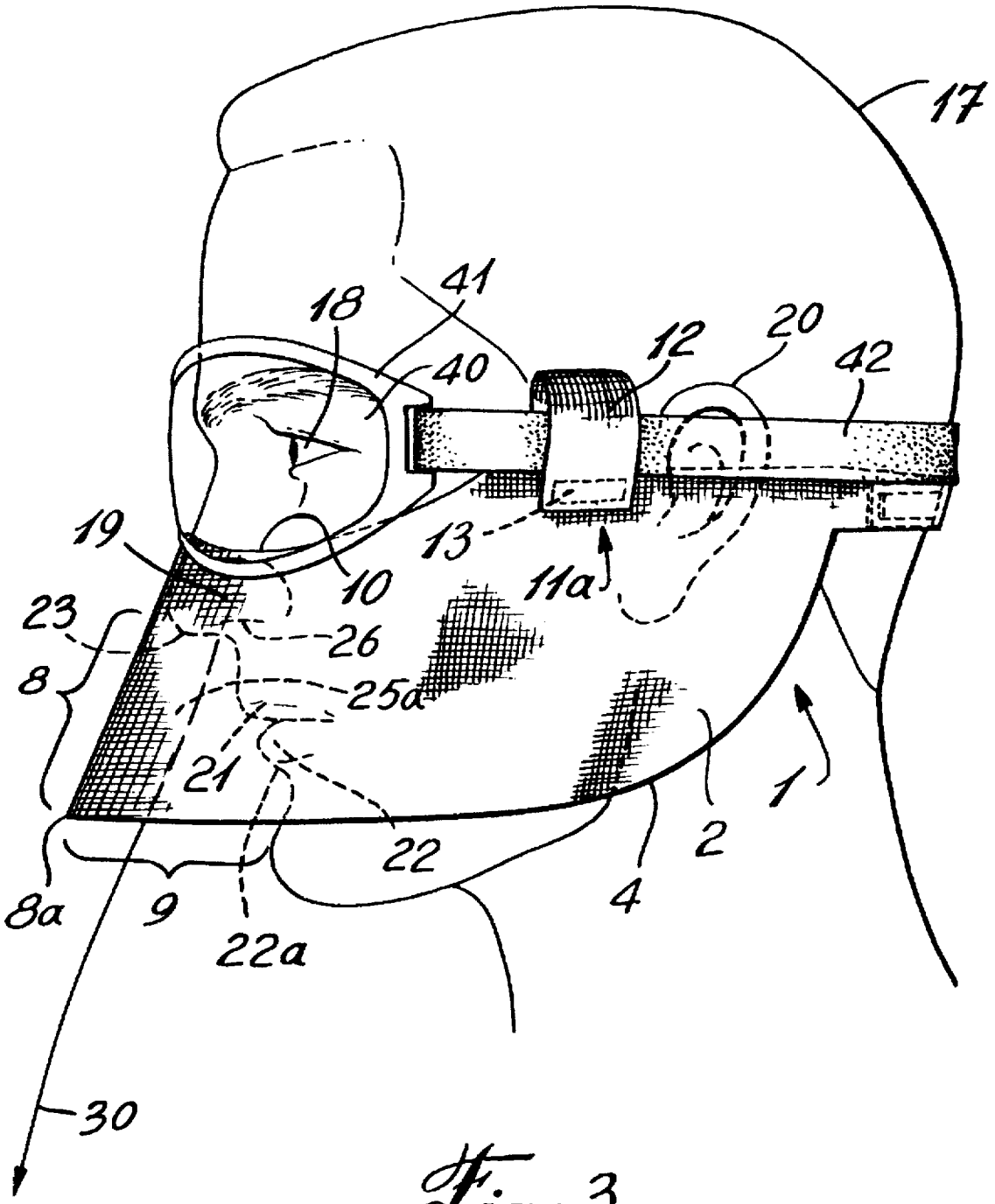
FIG. 3 is a schematic side view of a user's head showing the face protector of FIG. 1 attached thereto and in addition goggle means as well.

FIG. 3 shows the face protector 1 installed as in FIG. 2 being used in combination with goggle means 40. The goggle means 40 has a goggle rim member 41 about the eyepiece part thereof. The goggle means 40 also has an elastic band member 42 by which the goggle means 40 are removably attached or strapped to the head 17 of the user.

The lower part of the goggle rim member 41 is contoured to fit over the nose and under the eye socket area of the user; in FIG. 3 the lower part of the goggle rim member 41 is seen as following the contour under one eye of the user up to and over the nose; the lower part of the goggle rim member is symmetrically disposed in the same fashion with respect to the hidden side of the face, i.e. with respect to the other hidden eye. The lower part of the goggle rim member 41 sits on or abuts the central edge portion 10. The biasing induced by the elastic band 42 is such that the edge portion 10 is sandwiched or squeezed between the face of the user and the goggle means and acts as a kind of sealing gasket which prevents or inhibits backflow of humid air into the goggles from the air pocket mentioned above.

FIG. 3 also shows the face protector 1 as being attached to the elastic band by attachment means 11*a*. As may be appreciated a flap 12 is looped over the band 42 and is held in place by the respective loop and pile fastening means. The elastic band is similarly engaged by the fastening means 11 on the other side of the user's head.

Figure 4:
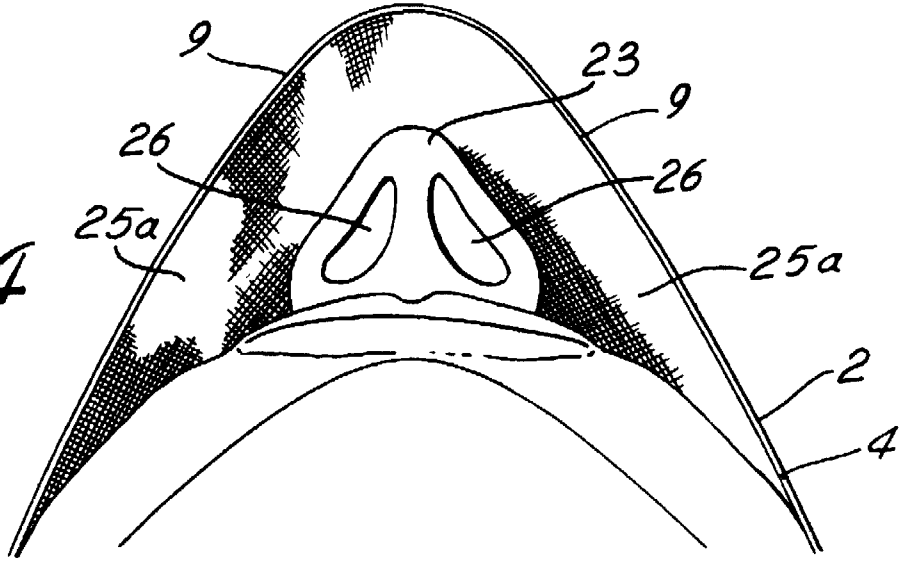
FIG. 4 is a schematic partial bottom view of a user's head showing the face protector of FIG. 1 attached thereto as seen in the direction from below the user's nose.

FIG. 4 shows a partial view of the face protector 1 strapped to the user as shown in FIG. 2 when viewed from below in the direction of the arrow 45 (see FIG. 2).

Figure 5:
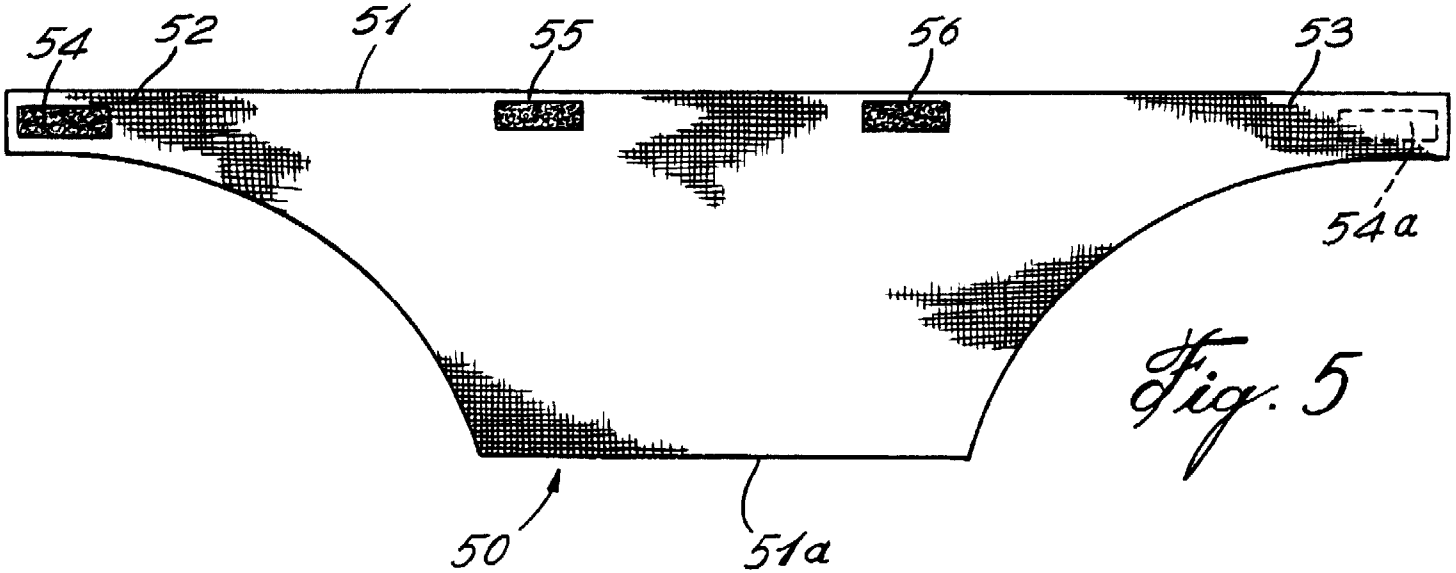
FIG. 5 is a from view of an example embodiment of a second flexible lower member in accordance with the present invention.

FIG. 5 illustrates a possible second flexible lower member 50 for use in conjunction with the face protector 1 shown in FIG. 1. The second flexible lower member 50 is in the form of a scarf band for covering the chin and neck areas of a user. The lower member 50 is shown with the from face or surface thereof exposed; the rear or skirt side surface of the lower member is hidden from view on the other opposite side of the member 50. The lower member 50 has a second upper edge 51 and a second lower edge 51*a*. The lower member 50 has attachment strip members 52 and 53 which are respectively connected to opposite ends of the second flexible lower member 50. The attachment members 52 and 53 respectively include a loop element 54 and a pile element 54*a* which are disposed on opposite sides of the face protector, i.e. the loop and pile elements 54 and 54*a* make up a Velcro® style releasable fastener or attachment means. The lower member 50 is provided with pile elements 55 and 56 which are intended to cooperate with corresponding loop elements of the first flexible upper member so as to provide a releasable connection therebetween, i.e. in the style of a Velcro® type connection. If desired of course one or both of the pile elements 55 and 56 may be replaced by a loop element; in this case it is of course necessary that the correspond attachment element of the first flexible upper member be changed to a corresponding pile element.

Figure 6:
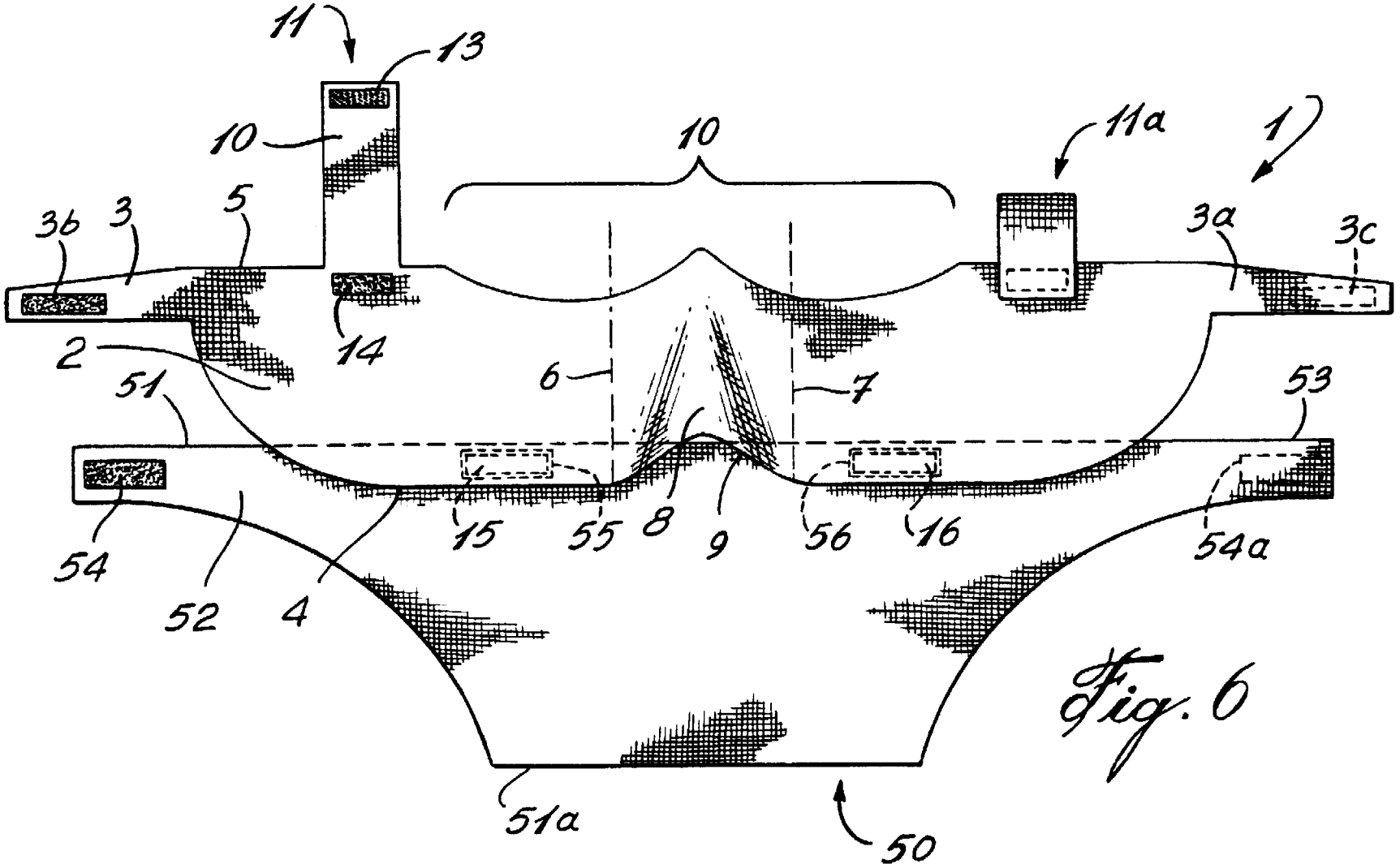
FIG. 6 is a front perspective view of a face mask comprising the combination of the face protector shown in FIG. 1 as attached to the second flexible lower member shown in FIG. 5.

Turning now to FIG. 6, this figure shows the face protector of FIG. 1 attached to the second flexible lower member of FIG. 5, i.e. it shows a face mask comprising the combination of the face protector shown in FIG. 1 as attached to the second flexible lower member shown in FIG. 5. The distance between pile elements 55 and 56 shown in FIG. 5 and the distance between the loop elements 15 and 16 of the face protector shown in FIG. 1 is such that when the pile element 55 is attached to the loop element 15 and the pile elements 56 is attached to the loop element 16 the central area of the face protector 1 illustrated as being bounded by the dotted lines 6 and 7 is pinched outwardly so as to define the nose pocket 25*a*. It is understood that outwardly is meant to mean in a direction away from the face of the user when the face protector is worn by the user. These Velcro® style attachment means are also disposed such that when the face mask of FIG. 6 is strapped to a user as shown in FIG. 7 a portion of the upper edge 51 of the second flexible lower member 50 is disposed adjacent the mouth area of the user at a level which is at least as low as the lower edge 22*a* of the lower lip 22 of the user (e.g. at a level which is below the lower edge of the lower lip about the lower edge of the chin).

Figure 7:
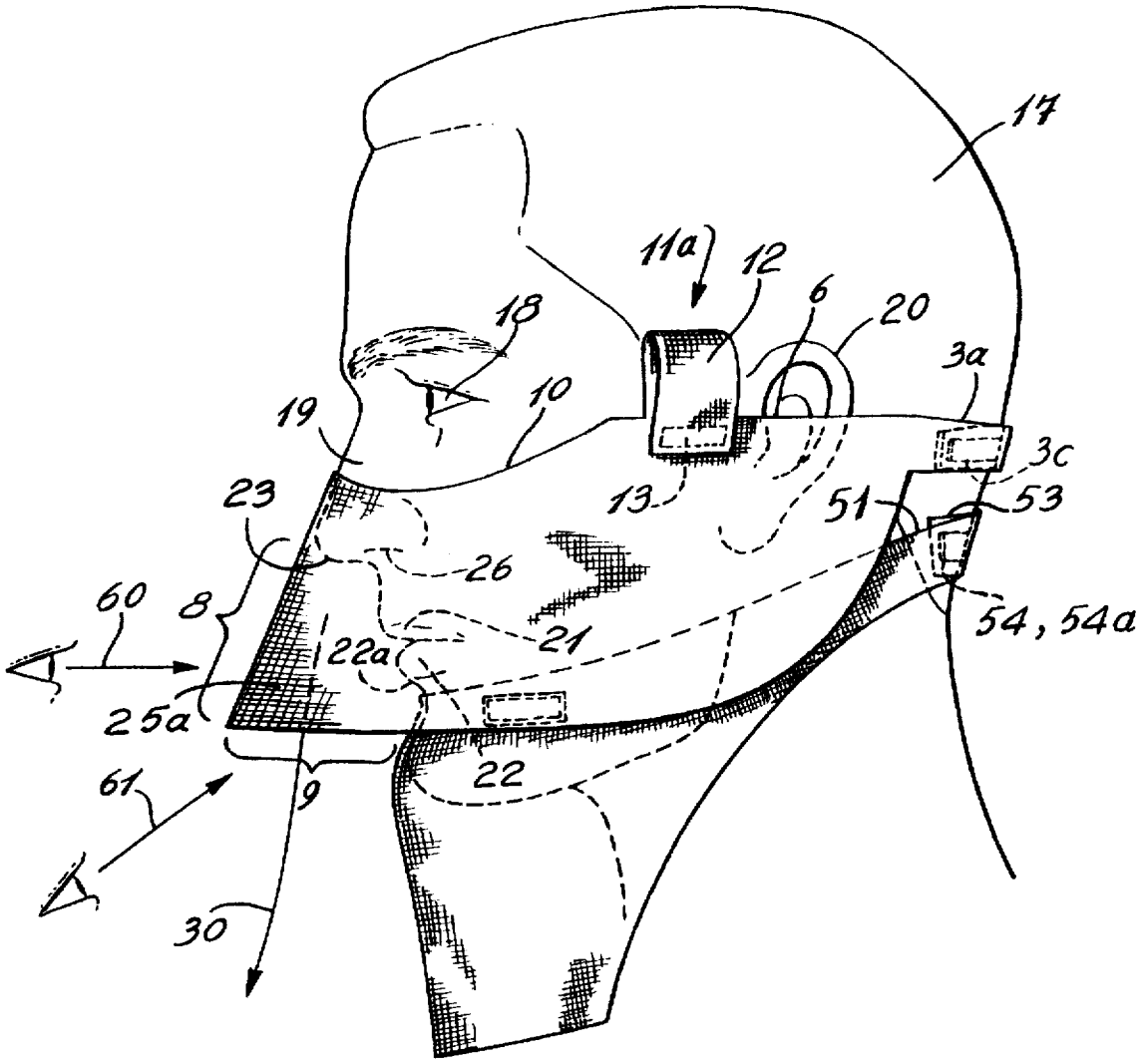
FIG. 7 is a schematic side view of a user's head showing the face mask as illustrated in FIG. 6 attached thereto.

As mentioned FIG. 7 shows the face mask of FIG. 6 attached to the head of a user. Since the mask includes the face protector 1 as shown in FIG. 1 and the face protector 1 is, apart from the presence of the lower member 50, strapped to a user as shown in FIGS. 2 and 3, reference may be had back to the above comments with respect to the air pocket 25*a*, skirt edge 9 level, the sealant effect of the central edge portion 10 when associated with goggles, etc.

Figure 8:
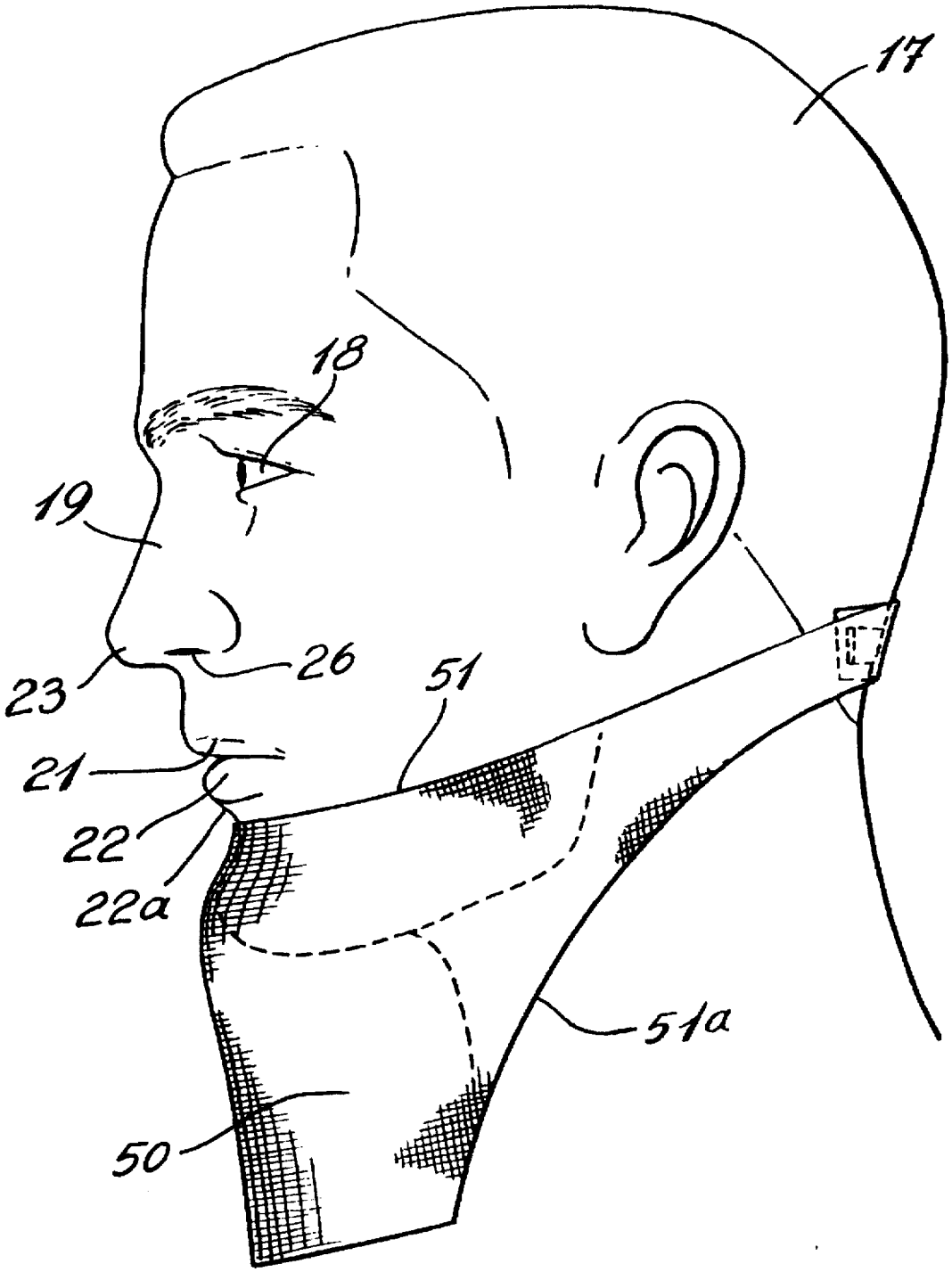
FIG. 8 is a schematic side view of a user's head showing the second flexible lower member shown in FIG. 2 attached thereto.

FIG. 8 shows only the second flexible lower member 50 as being worn by the user. As may be seen the lower member 50 covers the lower chin part of the face as well as the neck of the user. The lower member 50 is held in place by the attachment members 51 and 52

Figure 9:
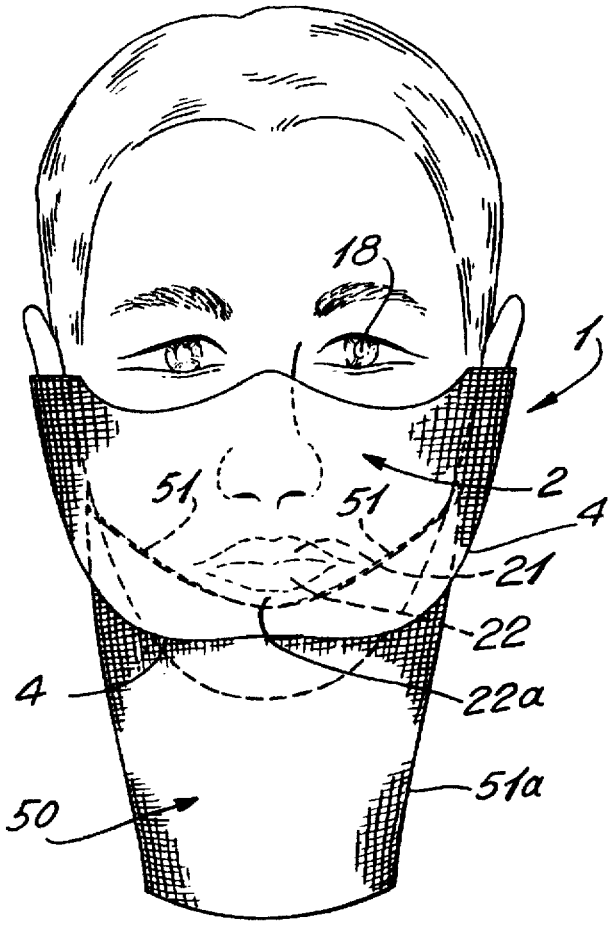
FIG. 9 is a partial schematic front view of the combination of FIG. 6 as shown worn by a user in FIG. of 7.

FIG. 9 shows a partial from view of the face mask as shown in FIG. 7 strapped to a user, the view being seen in the direction of the arrow 60 in FIG. 7. As can be seen, the covering body 2 of face protector 1 covers the area of the face of the user below eyes (e.g. below the eye socket area) over the upper cheek area. The covering body 2 covers the user's face from the bridge of the nose down to the mouth, such that the nose 19 and the nostrils 26 are protected. As can be seen, skirt edge 9 covers the user's face to below the lower edge 22*a* of lower lip 22. It is understood, however that skirt edge 9 may, if desired or necessary cover the user's face only to the upper edge of the upper lip 21. The lower member 50 on the other hand affords protection to the body of the mandible, chin 20 and neck of the user.

Figure 10:
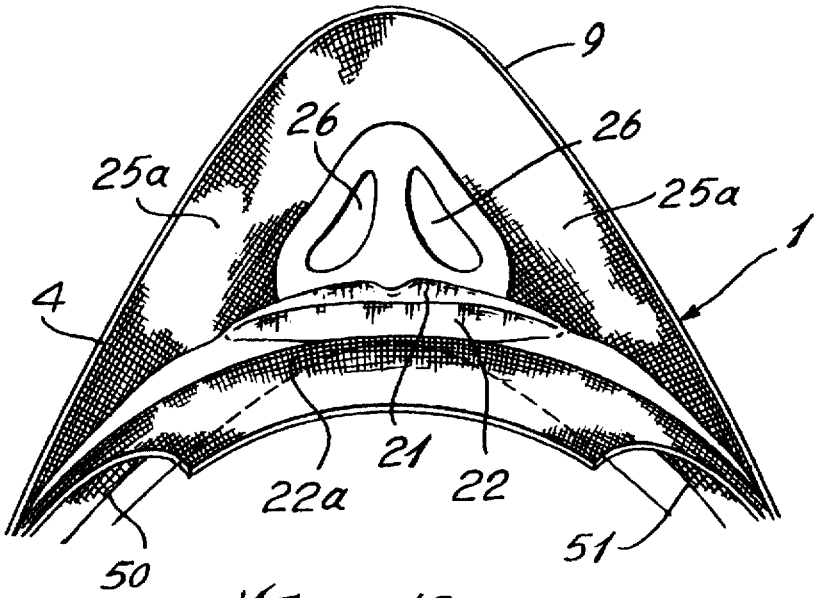
FIG. 10 is partial schematic front view from below of the combination of FIG. 6 as shown worn by a user in FIG. 7.

FIG. 10 shows a partial from view of the face mask as shown in FIG. 7 strapped to a user, the view being seen in the direction of the arrow 61 in FIG. 7. As may be understood the disposition of the skirt edge 9 and the portion of the edge 51 adjacent the mouth is such that the user may be able to breathe in and out through mouth if so desired. This design also allows the user to speak unhindered, i.e. the mouth of the user is not impeded by the face protector 1 nor the lower member 50. The breathing vent skirt element provides easy access to fresh air and facilitates the expulsion of humid air through the air pocket 25*a* while providing protection from cold wind, etc.

As can further be seen in FIG. 10, the second upper edge 51 of the second flexible lower member 50 covers the chin of the user up to but not including the lower edge 22*a* of the lower lip 22.

The face mask 1 may be provided in different sizes (i.e. small, medium, large) for user of different sizes. Further, the face mask 1 can be provided in children, woman and men size to further accommodate for various dimension and sizes of various users.

As here shown, the face protector 1 is made of a material suitable for placement upon and proximate the skirt of the user. More specifically, the preferred embodiment is to employ a POLAR TECK®, type of material which are readably available. The material presents the user with a smooth surface to facilitate the feeling of warmth and comfort. It is of course understood that any suitable material or combination of materials may be used in the construction of face protector 1.

I claim:

1. A face mask comprising a first flexible upper member comprising a first upper edge, a first lower edge, and a breathing vent skirt element said breathing skirt vent element having a skirt edge defined by a portion of said first lower edge, a second flexible lower member comprising a second upper edge and a second lower edge, first attachment means for releasably attaching said first flexible upper member to a user, second attachment means for releasably attaching said second flexible lower member to a user, third attachment means for releasably attaching said first flexible upper member to said second flexible lower member, said first upper member, said second lower member and said third attachment means being configured such that when the said first upper member is attached to the second lower member and the said face mask is worn by the user, said breathing vent skirt element, from the tip of the nose of the user, projects outwardly and extends downwardly such that said breathing vent skirt element defines an outer wall of a nostril air pocket extending below the nostril area of the user's nose, said nostril air pocket having a lower nostril opening, said nostril air pocket being in air communication, at an upper end thereof, with the nostril area of the user's nose and, at the lower nostril opening, with the atmosphere, and the skirt edge defines a portion of said lower nostril opening and is disposed so as to be at a level at least as low as the upper edge of the upper lip of the user said nostril air pocket being configured and disposed such that when air is exhaled by the user, the exhaled air is directed downwardly from the user's nostril area into the atmosphere, through the lower nostril opening, said first upper member and said second lower member being configured such that when the said face mask is worn by the user, a portion of the second upper edge of the second lower member is disposed adjacent the mouth area of the user and is disposed at a level adjacent to or lower than the lower edge of the lower lip of the user's mouth and defines a portion of the lower nostril opening said first upper edge of said first upper member comprising a goggle gasket edge portion configured such that when a user wears said face mask and goggle means comprising a goggle rim member contoured to fit over the nose and under the eye socket area of the user, the goggle gasket edge portion is able to fit contourly over the bridge of the nose and under the eye socket areas of the user such that said goggle rim member is able to engage said gasket edge portion so as to sandwich the said gasket edge portion between the face of the user and the said goggles.

2. A face mask as defined in claim 1 wherein the skirt edge is disposed so as to be at a level at least as low as the lower edge of the lower lip of the user.

3. A face mask as defined in claim 2 including fourth attachment means for securing said first flexible upper member to head attachment means of said goggle means when said goggle means and said face mask attachment means are worn by the user.

4. A face mask as defined in claim 2 wherein said fastener means comprises loop and pile fastener means.

5. A face mask as defined in claim 2 wherein the first and second member are each of a fabric material and have opposing first and second surfaces.

6. A face mask as defined in claim 5 wherein the first surface is of a water repellent fabric and the second surface is of soft fabric which can be worn against a user's skirt.

7. A face mask as defined in claim 3 wherein said fourth attachment means are loop and pile fastener means comprising two loop and pile fastener elements, each loop and pile element being attached and disposed on said first upper member such that when said first upper member is attached to said user's head, each loop and pile element is disposed on opposite side of user's head.

8. A face mask as defined in claim 2 wherein said first upper member is configured in the form of a first band having opposite ends, wherein said second lower member is configured in the form of a second scarf band having opposite ends, wherein said first attachment means comprises first fastening means for releasably attaching said opposite ends of the first band member together for attaching said first band to a user, and wherein second attachment means comprises second fastener means for releasably attaching said opposite ends of said scarf band for attaching said second scarf band to a user.

* * * * *